United States Patent [19]

Salmi et al.

[11] Patent Number: 4,736,806

[45] Date of Patent: Apr. 12, 1988

[54] CONTINUOUSLY REVOLVING PERCUSSION DRILLING MACHINE

[75] Inventors: Pekka Salmi, Tampere; Hannu Paasonen, Nokia, both of Finland

[73] Assignee: Oy Tampella AB, Tampere, Finland

[21] Appl. No.: 4,293

[22] Filed: Jan. 5, 1987

Related U.S. Application Data

[63] Continuation of Ser. No. 531,436, Sep. 12, 1983, abandoned.

[30] Foreign Application Priority Data

Sep. 27, 1982 [FI] Finland ..... 823315

[51] Int. Cl.[4] ..... B23B 45/16; B25D 9/00

[52] U.S. Cl. ..... 173/104; 74/438

[58] Field of Search ..... 173/104, 105; 74/413, 74/421 R, 424.5, 438, 665 GD

[56] References Cited

U.S. PATENT DOCUMENTS

| | | | |
|---|---|---|---|
| 1,459,402 | 5/1921 | Johnson | 81/464 |
| 3,082,741 | 3/1963 | Huffman | 173/96 |
| 3,166,131 | 1/1965 | Worman | 173/105 |
| 4,002,347 | 1/1977 | Wanner et al. | 173/104 |
| 4,073,348 | 2/1978 | Schramm et al. | 173/109 |
| 4,229,981 | 10/1980 | Macky | 173/48 |
| 4,261,225 | 4/1981 | Zahrandik | 74/413 |
| 4,289,209 | 9/1981 | Salmi | 173/107 |

*Primary Examiner*—E. R. Kazenske
*Assistant Examiner*—James Wolfe
*Attorney, Agent, or Firm*—Ladas & Parry

[57] ABSTRACT

Continuously revolving percussion drilling machine, which comprises a body (1), a drill shank (2) mounted rotatably and axially slidably in the body for causing impacts on the drill rod, an impact mechanism (3) positioned in the body for causing axial impacts on the drill shank, and a rotating device (4) for rotating the drill shank around its axis. The drill shank is provided with a toothing (8), which is coupled in direct engagement with a toothing (9) revolving in relation to the drill shank and rotating the drill shank, said toothing of the drill shank being axially displaceable in relation to said rotating toothing, so that the contact surfaces of the teeth of the toothing on the drill shank and of the toothing rotating the drill shank revolve and are exchanged constantly. The teeth operate cold and well lubricated. The rotating toothing may be a cogwheel or a tooth rim.

6 Claims, 2 Drawing Sheets

CONTINUOUSLY REVOLVING PERCUSSION DRILLING MACHINE

Figure 1:
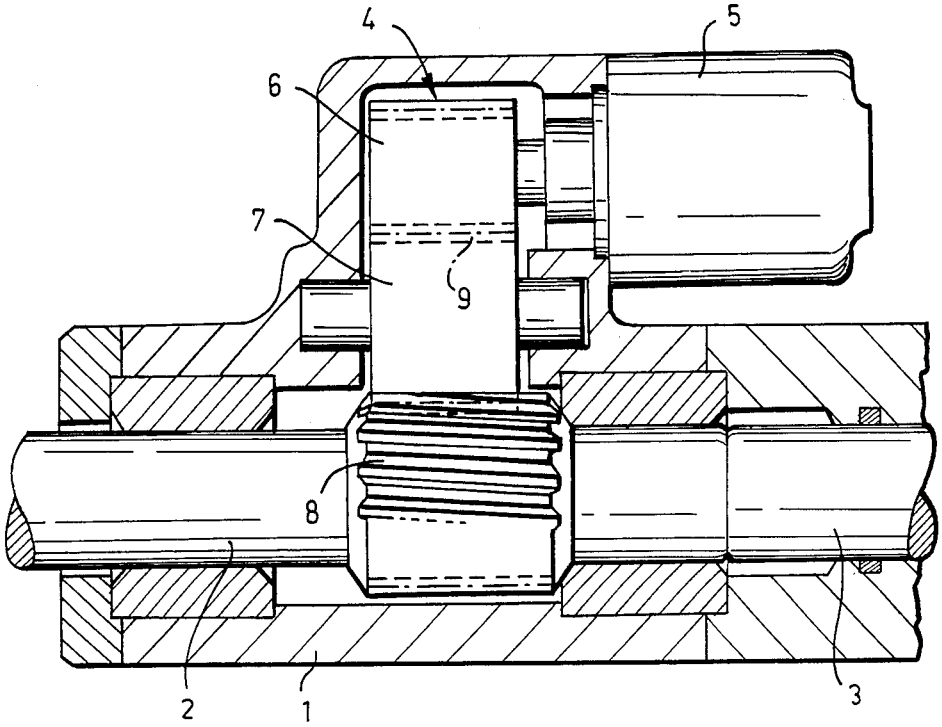

This is a continuation of co-pending application Ser. No. 531,436 filed on 9/12/83 now abandoned.

The present invention is concerned with a continuously revolving percussion drilling machine which comprises a body, a drill shank mounted rotably and axially slideably in the body for causing impacts on the drill rod, an impact mechanism positioned in the body for causing axial impacts on the drill shank, and a rotating device for rotating the drill shank around its axis, whereby the drill shank is provided with a toothing by means of which the drill shank is coupled in engagement with the rotating device.

In a continuously revolving percussion drilling machine, the drill rod is rotated constantly during drilling, at the same time as successive impacts are directed at the drill rod. The transmission of the torque of rotation from the rotating device to the drill shank has been accomplished by means of a toothing provided on the drill shank, to which toothing the power is transmitted from the rotating device by means of a grooved sleeve and a frame sleeve (e.g., U.S. Pat. No. 3,082,741) or by means of a frame sleeve (e.g., U.S. Pat. No. 4,289,209) provided with toothed grooves corresponding to the toothing on the drill shank. The toothings do not revolve in relation to each other, but form a groove-wedge joint between the drill shank and the groove sleeve or the frame sleeve.

A problem in conventional percussion drilling machines is the tooth transmission between the drill shank and the groove sleeve or frame sleeve, because, at the same time as the teeth of the toothings are in tight contact with each other owing to the torque of rotation, 1500 to 5000 impacts per minute are repeatedly directed at the drill shank by means of the percussion mechanism, so that a high speed movement back and forth is imparted to the drill shank, said speed being about 5 to 10 meters per second. Owing to this, a large quantity of heat is generated in the surfaces of the teeth, which results in shear of the teeth and in melting of the material and in rapid wear. In order to avoid this, most varying combinations of materials have been used in the tooth surfaces, but with relatively poor results. In order to reduce the surface pressure and to reduce the said drawbacks, attempts have been made to distribute the surface pressure among several teeth over an area as large as possible.

The prior art constructions also involve drawbacks in view of their manufacture, such as the inside toothing comprising teeth having straight flanks, in which the precision of the pitch is poor and only some of the teeth are supporting. Also, the surface quality of the teeth is often poor, which results in high local surface pressures damaging the toothing, and thereby in a relatively poor result. Moreover, it is difficult to provide adequate lubrication between the tooth surfaces sliding against each other, which deteriorates the situation even further. The prior art constructions are also expensive to manufacture, and the expenses of spare parts are high.

The object of the present invention is to provide a percussion drilling machine which avoids the above drawbacks and in which the generation of heat in the toothing of the drill shank is low and the lubrication can be accomplished reliably. This object is achieved by means of a percussion drilling machine in accordance with the present invention, which is characterized in that the toothing of the drill shank is coupled in direct engagement with a toothing revolving in relation to the drill shank and rotating the drill shank, said toothing of the drill shank being axially displaceable in relation to said rotating toothing.

The invention is based on the idea that the contact surfaces of the teeth of the toothing of the drill shank and of the toothing rotating the drill shank revolve and are exchanged constantly, whereby the same position of each tooth is not subjected to successively repeated axial movement nor to strain caused by surface pressure, and the contact faces have time to be cooled before the next contact. Owing to this, the teeth operate sufficiently cold, and since the surfaces are apart from each other between contacts, they obtain a good lubricating film.

The toothings on the drill shank and on a rotating cogwheel or tooth rim can be manufactured by means of a so called generating method. The result is more precise toothings, whereby no exceptionally high local surface pressures are produced at the surfaces of the teeth, but all the teeth which are in contact at the same time support the loading uniformly.

It is a surprising feature of the invention that, in spite of the fact that the power required for rotating the drill shank is transmitted via a few teeth only which are in contact with each other at one time and which are displaceable in relation to each other, so that the contact area is relatively little, the wear resistance of the toothing of the drill shank is considerably better than in the prior art solutions, in which the number of teeth participating in the power transmission and the power transmission area are large as compared with the solution of the present invention. Correspondingly, the service life of the drill shank is prolonged, which reduces the spare part expenses. The elimination of the conventional expensive groove sleeve and/or frame sleeve construction simplifies the entire construction and lowers both the manufacturing costs and the spare part costs.

Figure 2:
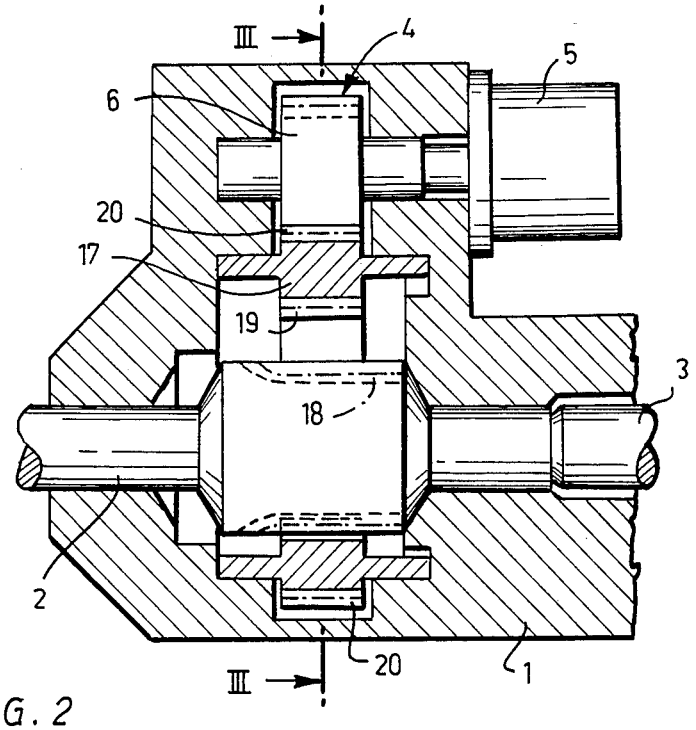
Figure 3:
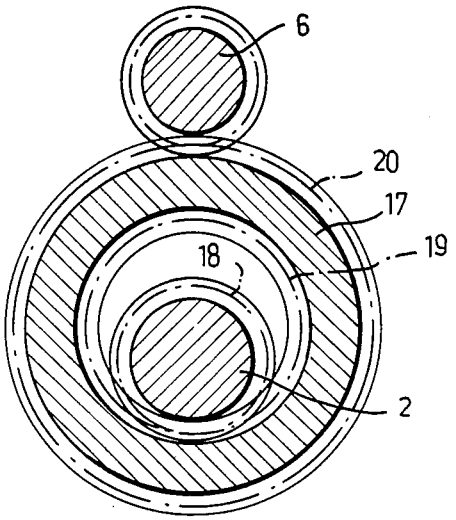

The invention will be described in more detail below with reference to the attached drawings, wherein FIG. 1 is an axial cross section of the front end of the percussion drilling machine in accordance with the invention, illustrating a first embodiment of the gear transmission of the drill shank, FIG. 2 shows a second embodiment of the gear transmission of the drill shank in a way corresponding to FIG. 1, and FIG. 3 shows a section along line III—III in FIG. 2.

As its main components, the percussion drilling machine shown in FIG. 1 comprises a body 1, a drill shank 2 rotably and axially slidably journalled in the body, an impact mechanism provided in the body, of which only the axially mobile impact piston 3 is shown, and a rotating device 4 mounted in the body. In FIG. 1 only the front end of the drilling machine is shown, because the invention is actually concerned with the rotating members provided in the front end. In other respects, the construction of the drilling machine is conventional and it is therefore not described in more detail in this connection.

The rotating device 4 includes a rotating motor 5 having a shaft to which is fastened a cogwheel 6 in engagement with a cogwheel 7 mounted in the body. A toothing 8 consisting of an outside tooth rim has been formed on the drill shank, said toothing being in engagement with the toothing 9 on the cogwheel 7.

For rotating the drill shank, an ordinary cogwheel 7 is used in this embodiment. The toothing on the drill shank is coupled in direct engagement with this cogwheel. In the embodiment of FIG. 1 the cogwheel 7 is arranged as an intermediate cogwheel between the cogwheel 6 of the rotating motor and the drill shank. It is also possible that the cogwheel with which the toothing of the drill shank is coupled in direct engagement is the cogwheel 6 of the rotating motor.

In the embodiment shown in FIGS. 2 and 3, a tooth rim 17 is journalled rotably in the body, said tooth rim being positioned around the drill shank. The tooth rim is provided with an inside toothing 19, which is coupled in direct engagement with the toothing 18 on the drill shank, and with an outside toothing 20, which is in engagement with the cogwheel 6 of the rotating motor.

The teeth of the toothing 18 of the drill shank and the teeth of the toothing 9 of the cogwheel or of the toothing 19 of the tooth rim, respectively, may be straight, as is shown in FIG. 2, or helical, as is shown in FIG. 1. By means of helical gears, it is possible to make the tooth contact lighter or substantially during the axial movement of the drill shank. The helicity of the teeth may vary within 0° to 10°, the preferable helicity being about 1° to 5°. The direction of helicity in relation to the direction of rotation of the drill depends on whether the tooth contact is supposed to be made lighter during the impact movement or during the return movement.

The drawings and the related description are only supposed to illustrate the idea of the invention. In its details, the percussion drilling machine in accordance with the invention may vary within the scope of the claims. The tooth rim with which the toothing on the drill shank is coupled in direct engagement may be an element of the rotating device, such as the inner body of such a hydraulic motor in which the outer body and the inner body revolve relative each other, a toothing being provided on the inner body. It is also possible to couple several rotating motors to act upon the drill shank in parallel in relation to each other by arranging their cogwheels so that they rotate the drill shank at different sides thereof.

What is claimed is:

1. A continuously revolving percussion drilling machine, comprising:

a body;

impact means positioned within the body, said impact means causing axial impacts on a drill shank, the drill shank mounted rotatably and axially slidably within the body and causing impacts on a drill rod, rotating means for rotating the drill shank about a longitudinal axis thereof, the drill shank having a helical toothing for direct and rotatable engagement with a helical toothing of said rotating means, the toothing of said rotating means continuously revolving and making complete revolutions in relation to the drill shank, the drill shank toothing extending away from said impact means and inclined with respect to the axial direction of impact in a direction opposite from the direction of rotation whereby contact between the toothing of the drill shank and the toothing of said rotating means are substantially reduced during impact movement of the drill shank.

2. A continuously revolving percussion drilling machine as claimed in claim 1, characterized in that the toothing (8) of the drill shank (2) is in engagement with a toothing (9) of a cogwheel (6, 7), which is directly or indirectly coupled to said rotating means (4).

3. A continuously revolving percussion drilling machine as claimed in claim 1, characterized in that the toothing (18) of the drill shank (2) is in engagement with a toothing (19) of a tooth rim (17), said tooth rim being rotatingly mounted in the body of the drilling machine and being positioned around the drill shank, which tooth rim is directly or indirectly coupled to said rotating means (4).

4. A continuously revolving percussion drilling machine as claimed in claim 3, characterized in that the tooth rim (17) is a part of the rotating motor.

5. A continuously revolving percussion drilling machine as claimed in claim 1 further including means for directly rotatably driving said rotating means.

6. A continuously revolving percussion drilling machine as claimed on claim 5 wherein said means for directly rotatably driving is an electric motor.

* * * * *